US008696832B2

(12) United States Patent
Kaneko et al.

(10) Patent No.: US 8,696,832 B2
(45) Date of Patent: Apr. 15, 2014

(54) HIGH-STRENGTH HOT-ROLLED STEEL SHEET AND METHOD FOR MANUFACTURING SAME

(75) Inventors: Shinjiro Kaneko, Tokyo (JP); Kaneharu Okuda, Tokyo (JP); Tetsuo Shimizu, Tokyo (JP); Noriaki Moriyasu, Tokyo (JP); Masahide Watabe, Tokyo (JP)

(73) Assignee: JFE Steel Corporation (JP)

( * ) Notice: Subject to any disclaimer, the term of this patent is extended or adjusted under 35 U.S.C. 154(b) by 286 days.

(21) Appl. No.: 12/866,513

(22) PCT Filed: Feb. 4, 2009

(86) PCT No.: PCT/JP2009/052245

§ 371 (c)(1),
(2), (4) Date: Aug. 6, 2010

(87) PCT Pub. No.: WO2009/099238

PCT Pub. Date: Aug. 13, 2009

(65) Prior Publication Data

US 2010/0314010 A1 Dec. 16, 2010

(30) Foreign Application Priority Data

Feb. 8, 2008 (JP) ..... 2008-028453

(51) Int. Cl.
*C22C 38/14* (2006.01)
*C22C 38/04* (2006.01)
*C21D 8/02* (2006.01)

(52) U.S. Cl.
USPC ..... 148/328; 148/320; 148/601; 148/602; 148/654

(58) Field of Classification Search
CPC ..... C22C 38/14; C22C 38/04; C21D 8/0226
USPC ..... 148/320, 328, 601, 602, 654
See application file for complete search history.

(56) References Cited

U.S. PATENT DOCUMENTS

| | | | | |
|---|---|---|---|---|
| 4,472,208 | A | 9/1984 | Kunishige | |
| 2004/0035508 | A1 | 2/2004 | Hiroyuki et al. | |
| 2009/0205756 | A1 * | 8/2009 | Nakamura et al. | 148/602 |

FOREIGN PATENT DOCUMENTS

| | | |
|---|---|---|
| JP | 4-289125 A | 10/1992 |
| JP | 6-172924 | 6/1994 |

(Continued)

OTHER PUBLICATIONS

T. Kashima et al., "Stretch-flangeability of High Strength Hot Rolled Steel Sheets with Bainitic-ferrite Microstructure," *Tetsu to Hagane: Journal of the Iron and Steel Institute of Japan*, vol. 67, No. 3, Mar. 1, 2001, pp. 146-151. (Abstract Only).

(Continued)

*Primary Examiner* — Deborah Yee
(74) *Attorney, Agent, or Firm* — DLA Piper LLP (US)

(57) ABSTRACT

A high-strength hot-rolled steel sheet has a tensile strength (TS) of 540 to 780 MPa, only small variations in strength, and excellent uniformity in strength using a general-purpose Ti-containing steel sheet, which is inexpensive. The high-strength hot-rolled steel sheet includes, on a mass percent basis, 0.05%-0.12% C, 0.5% or less Si, 0.8%-1.8% Mn, 0.030% or less P, 0.01% or less S, 0.005%-0.1% Al, 0.01% or less N, 0.030%-0.080% Ti, and the balance being Fe and incidental impurities. The microstructure have a bainitic ferrite fraction of 70% or more, and the amount of Ti present in a precipitate having a size of less than 20 nm is 50% or more of the value of Ti* calculated using formula (1): $Ti^*=[Ti]-48/14\times[N]$ (1) where [Ti] and [N] represent a Ti content (percent by mass) and a N content (percent by mass), respectively, of the steel sheet.

3 Claims, 2 Drawing Sheets

(56) References Cited

FOREIGN PATENT DOCUMENTS

| | | | |
|---|---|---|---|
| JP | 6-200351 | A | 7/1994 |
| JP | 7-011382 | A | 1/1995 |
| JP | 2002-161340 | A | 6/2002 |
| JP | 2002-322541 | A | 11/2002 |
| JP | 2004-027249 | A | 1/2004 |
| JP | 2007-239097 | A | 9/2007 |
| WO | WO2008007753 | A1 * | 1/2008 |

OTHER PUBLICATIONS

P. J. Evans et al., "High strength C-Mn steels for automotive applications," *Ironmaking & Steelmaking: Processes, Products and Applications*, vol. 24, No. 5, Jan. 1, 1997, pp. 361-367.

* cited by examiner

HIGH-STRENGTH HOT-ROLLED STEEL SHEET AND METHOD FOR MANUFACTURING SAME

RELATED APPLICATIONS

This is a §371 of International Application No. PCT/JP2009/052245, with an international filing date of Feb. 4, 2009, which is based on Japanese Patent Application No. 2008-028453 filed Feb. 8, 2008, the subject matter of which is incorporated by reference.

TECHNICAL FIELD

This disclosure relates to a high-intensity hot-rolled steel sheet having a tensile strength (TS) of 540 to 780 MPa, only small variations in strength, and excellent uniformity in strength between coils and within a coil, and being useful as a steel sheet for automobiles and so forth, and to a method for manufacturing the same.

BACKGROUND

From the viewpoint of global environmental protection, improvement in the fuel economy of automobiles has recently been required to regulate the amount of $CO_2$ emissions. In addition, it is also required to improve safety by focusing on collision characteristics of automobile bodies to ensure the safety of passengers at the time of a collision. Thus, both weight reduction and strengthening of automobile bodies are being actively promoted. To simultaneously achieve such weight reduction and strengthening of automobile bodies, an increase in the strength of a material for members and a reduction in weight by reducing the thickness of sheets to the extent that rigidity is not impaired are said to be effective. Nowadays, high-strength steel sheets are positively used for automotive parts. Use of high-strength steel sheets results in a significant weight reduction effect. Thus, in the motor vehicle industry, for example, there is a trend toward the use of steel sheets as a structural material with a TS of 540 MPa or more.

Many automotive parts made from steel sheets are manufactured by press forming. Regarding the formability of high-strength steel sheets, dimensional accuracy is important in addition to prevention of cracking and wrinkling. In particular, controlling springback is an important problem. Nowadays, new automobiles are developed very efficiently by computer assisted engineering (CAE). So, it is not necessary to make many dies. Furthermore, the input of the characteristics of a steel sheet enables predicting the amount of springback more accurate. Variations in the amount of springback cause problems when parts are connected to each other and thus should be reduced. So, in particular, a high-strength steel sheet having only small variations in strength and excellent uniformity in strength is required.

As a method for reducing variations in strength in a coil, Japanese Unexamined Patent Application Publication No. 4-289125 discloses the following method: In the case of hot-rolling Nb-containing low-manganese steel (Mn: 0.5% or less), a rough-rolled sheet bar is temporarily wound into a coil. Next, the sheet bar is joined to the preceding sheet bar while being unwound, and then continuously finish-rolled to achieve uniformity in the strength of the high-strength hot-rolled steel sheet in a coil. Japanese Unexamined Patent Application Publication No. 2002-322541 discloses a high-strength hot-rolled steel sheet with excellent uniformity in strength, i.e., only small variations in strength, produced by the addition of both Ti and Mo to form very fine precipitates uniformly dispersed therein.

The foregoing, however, have problems. The method described in JP 4-289125 has a problem in which when the sheet is wound into a coil, the sheet is divided. Furthermore, the addition of Nb causes an increase in cost, which is economically disadvantageous. In the steel sheet described in JP 2002-322541, which is a Ti system, it is necessary to add Mo, which is expensive, thus causing an increase in cost. Moreover, in both publications, two-dimensional uniformity in strength in the in-plane directions including both of the width direction and the longitudinal direction of the coil is not taken into consideration. Disadvantageously, even if the coiling temperature is uniformly controlled, variations in the in-plane strength of the coil are inevitably caused by different cooling histories for each position in the wound coil.

In consideration of the above-described situation, it could be helpful to provide a high-strength hot-rolled steel sheet having a tensile strength (TS) of 540 to 780 MPa, only small variations in strength, and excellent uniformity in strength using a general-purpose Ti-containing steel sheet, which is inexpensive, and to provide a method for manufacturing the high-strength hot-rolled steel sheet.

SUMMARY

We conducted intensive studies and provide a high-strength hot-rolled steel sheet having excellent uniformity in strength and only small variations in strength over the entire area of the hot-rolled steel sheet by controlling the chemical composition and the metal microstructure of the steel sheet and the precipitation state of Ti that contributes to precipitation strengthening.

This results in steel sheets and methods for manufacturing the high-strength hot-rolled steel sheets described below, the steel sheets having only small variations in in-plane strength and excellent uniformity in strength.

We thus provide:

[1] A high-strength hot-rolled steel sheet includes, on a mass percent basis, 0.05%-0.12% C, 0.5% or less Si, 0.8%-1.8% Mn, 0.030% or less P, 0.01% or less S, 0.005%-0.1% Al, 0.01% or less N, 0.030%-0.080% Ti, the balance being Fe and incidental impurities, and metal microstructures whose bainitic ferrite fraction is 70% or more, wherein the amount of Ti present in a precipitate having a size of less than 20 nm is 50% or more of the value of Ti* calculated using formula (1):

$$Ti^*=[Ti]-48/14\times[N] \quad (1)$$

where [Ti] and [N] represent a Ti content (percent by mass) and a N content (percent by mass), respectively, of the steel sheet.

[2] A method for manufacturing a high-strength hot-rolled steel sheet includes the steps of heating a steel slab to 1150° C. to 1300° C., the steel slab containing, on a mass percent basis, 0.05%-0.12% C, 0.5% or less Si, 0.8%-1.8% Mn, 0.030% or less P, 0.01% or less S, 0.005%-0.1% Al, 0.01% or less N, 0.030%-0.080% Ti, and the balance being Fe and incidental impurities, subjecting the slab to finish hot rolling at a finishing temperature of 800° C. to 950° C., starting cooling at a cooling rate of 20° C./s to 80° C./s within 2 seconds after the completion of the finish hot rolling, stopping cooling at 620° C. or lower, and subsequently performing coiling at 550° C. or higher.

It is possible to reduce variations in strength in a coil of a high-strength hot-rolled steel sheet having a tensile strength (TS) of 540 to 780 MPa, thereby achieving stabilization of the shape fixability of the steel sheet at the time of press forming and the strength and durability of a part. This leads to improvement in reliability at the time of production and use of an automotive part. Furthermore, the above-mentioned effect is provided without adding an expensive raw material such as Nb, thus reducing the cost.

DETAILED DESCRIPTION

Figure 1:
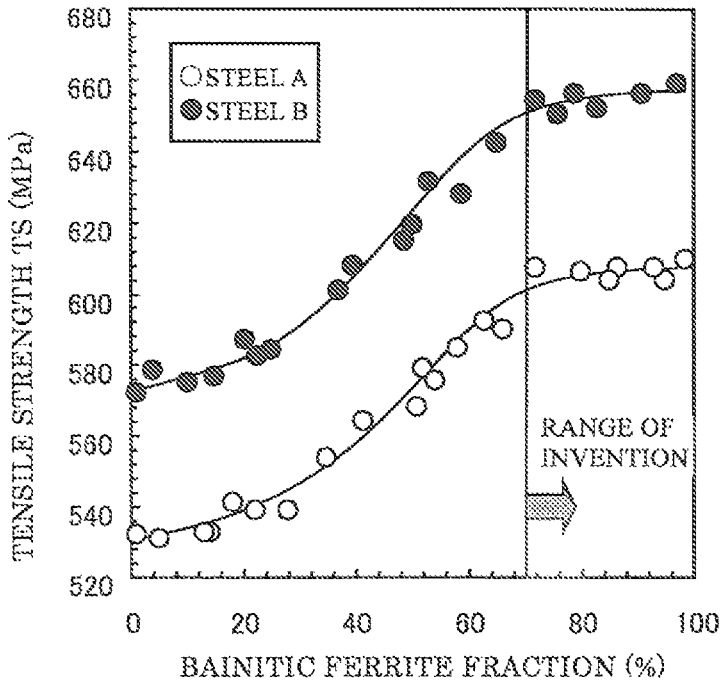
FIG. 1 shows the investigation results of the relationship between the bainitic ferrite fraction (%) and the tensile strength TS (MPa).

Our steel sheets and methods are described as follows:

1) A method for evaluating small variations in strength, i.e., uniformity in strength will be described.

An example of a target steel sheet is a coiled steel sheet having a weight of five tons or more and a steel sheet width of 500 mm or more. In this case, in an as-hot-rolled state, the innermost turn including the front end in the longitudinal direction, the outermost turn including the rear end in the longitudinal direction, and regions extending from both sides to 10 mm from both sides in the width direction are not evaluated. Variations in the strength of the steel sheet are evaluated on the basis of tensile-strength distribution obtained from two-dimensional measurement at least 10 points in the longitudinal direction and at least 5 points in the width direction. Furthermore, our steel sheets have a tensile strength (TS) of 540 MPa to 780 MPa.

2) The reason for the limitation of the chemical components (composition) of steel will be described below.

The units of the content of each component in the steel composition are "percent by mass" and are simply indicated by "%" unless otherwise specified.

C: 0.05% to 0.12%

C is an important element as well as Ti described below. C forms a carbide with Ti and is effective in increasing the strength of a steel sheet by precipitation strengthening. The C content is preferably 0.05% or more and more preferably 0.06% or more from the viewpoint of precipitation strengthening. A C content exceeding 0.12% is liable to adversely affect satisfactory elongation and flangeability. Thus, the upper limit of the C content is set to 0.12% and preferably 0.10% or less.

Si: 0.5% or Less

Si is effective in enhancing solid-solution strengthening and improving ductility. To provide the effect described above, the Si content is effectively 0.01% or more. A Si content exceeding 0.5% is liable to cause the occurrence of a surface defect called red scale during hot rolling, which can reduce the quality of surface appearance when a steel sheet is produced. Thus, the Si content is preferably 0.5% or less and more preferably 0.3% or less.

Mn: 0.8% to 1.8%

Mn is effective in achieving higher strength and has the effect of reducing the transformation point and the ferrite grain size. The Mn content needs to be 0.8% or more. More preferably, the Mn content is set to 1.0% or more. A Mn content exceeding 1.8% causes the formation of a low-temperature transformation phase after hot rolling to reduce the ductility and is liable to make TiC precipitation unstable. Thus, the upper limit of the Mn content is set to 1.8%.

P: 0.030% or Less

P is an element effective for solid-solution strengthening. P also has the effect of reducing the scale defect due to Si. An excessive P content more than 0.030%, however, is liable to cause the segregation of P into grain boundaries and reduce toughness and weldability. Thus, the upper limit of the P content is set to 0.030%.

S: 0.01% or Less

S is an impurity and causes hot tearing. Furthermore, S is present in the form of an inclusion in steel, deteriorating the various characteristics of a steel sheet. Thus, the S content needs to be minimized. Specifically, the S content is set to 0.01% because the S content is allowable to 0.01%.

Al: 0.005% to 0.1%

Al is useful as a deoxidizing element for steel. Al also has the effect of fixing dissolved N present as an impurity, thereby improving resistance to room-temperature aging. To provide the effect, the Al content needs to be 0.005% or more. An Al content exceeding 0.5% leads to an increase in alloy cost and is liable to cause surface defects. Thus, the upper limit of the Al content is set to 0.1%.

N: 0.01% or Less

N is an element which degrades the resistance to room-temperature aging and in which the N content is preferably minimized. A higher N content causes a reduction in resistance to room-temperature aging. To fix dissolved N, it is necessary to perform the addition of large amounts of Al and Ti. Thus, the N content is preferably minimized. The upper limit of the N content is set to 0.01%.

Ti: 0.030% to 0.080%

Ti is an important element to strengthen steel by precipitation strengthening. Ti contributes to precipitation strengthening by forming a carbide with C.

That is, to produce a high-strength steel sheet having a tensile strength TS of 540 MPa to 780 MPa, it is preferred to form fine precipitates each having a size of less than 20 nm. Furthermore, it is important to increase the proportion of the fine precipitates (each having a size of less than 20 nm). One of the reasons for this may be that precipitates having a size of 20 nm or more are less likely to provide the effect of suppressing dislocation migration and fail to sufficiently harden bainitic ferrite, which can reduce strength. It is thus preferred that the precipitates have a size of less than 20 nm. The fine precipitates containing Ti and each having a size of less than 20 nm are formed by the addition of Ti and C within the above ranges. In this specification, the precipitates containing Ti and C are generically referred to as a "Ti-containing carbide". Examples of the Ti-containing carbide include TiC and $Ti_4C_2S_2$. The carbide may further contain N as a component and may be precipitated in combination with, for example, MnS.

In the high-strength steel sheet, it is observed that the Ti-containing carbide having a precipitate size of less than 20 nm is mainly precipitated in bainitic ferrite. This is probably because supersaturated C is easily precipitated as a carbide in bainitic ferrite because of a low solid-solubility limit of C in bainitic ferrite. The precipitates further harden (strengthen) bainitic ferrite, thereby achieving a tensile strength (TS) of 540 MPa to 780 MPa. Furthermore, Ti is readily bonded to dissolved N and thus an element suitable for fixation of dissolved N. From that standpoint, the Ti content is set to 0.030% or more. However, an excessive addition of Ti only results in the formation of coarse undissolved TiC or the like, which is a carbide of Ti but does not contribute to strength, and is thus uneconomical, which is not preferred. The upper limit of the Ti content is set to 0.080% from this viewpoint.

It is preferred that the composition of the balance other than the components described above be substantially iron and incidental impurities.

3) The reason for the limitation of the steel microstructure of the steel sheet will be described below.

The steel sheet has microstructures whose bainitic ferrite fraction is 70% or more, and the amount of Ti in a precipitate having a size of less than 20 nm is 50% or more of the value of Ti* calculated using formula (1).

The strength of the high-strength hot-rolled steel sheet is determined by superposition of the amounts of strengthening based on three strengthening mechanisms, i.e., solid-solution strengthening, microstructural strengthening, and precipitation strengthening, on the base strength of the steel itself. The base strength is an inherent strength of iron. The amount of solid-solution strengthening is almost uniquely determined by chemical composition. Thus, these two strengthening mechanisms are negligibly involved in the variations in strength in a coil. The strengthening mechanism that is the most closely related to the variations in strength is precipitation strengthening, followed by microstructural strengthening.

The amount of strengthening by precipitation strengthening is determined by the size and dispersion of precipitates (specifically, precipitate spacing). The dispersion of precipitates can be expressed by the amount and size of the precipitates. Thus, if the size and amount of the precipitates are determined, the amount of strengthening by precipitation strengthening will be determined. Microstructural strengthening is determined by the type of steel microstructure. The type of steel microstructure is determined by a transformation-temperature range from austenite. If a chemical composition and a steel microstructure are determined, the amount of strengthening will be determined.

4) Experimental facts will be described below.

Steel A in which the amount of Ti added was 0.04% and steel B in which the amount of Ti added was 0.06%, each of steel A and steel B having a basic chemical composition of 0.08C-0.1Si-1.5Mn-0.011P-0.002S-0.017Al-0.005N, were ingoted in a laboratory into cast strands. These cast strands were formed into sheet bars each having a thickness of 25 mm by slabbing. Each of the sheet bars was heated to 1230° C., hot-rolled in five passes so as to have a finishing temperature of 880° C., and water-cooled at a cooling rate of 25° C./s 1.7 seconds after finish rolling. At this time, the cooling stop temperature was changed between 720° C. and 520° C. After the water cooling, each sheet bar was subjected to natural cooling for 10 seconds. Each sheet bar was inserted into an electric furnace having a temperature of 500° C. to 700° C. and wound. At this time, the holding time in the furnace was changed between 1 and 300 minutes. Hot-rolled steel sheets having different precipitation states of Ti and different steel microstructures were manufactured by the method described above. The hot-rolled steel strips were subjected to pickling and then temper rolling at an elongation of 0.5%. Test pieces for a tensile test and analytical samples of precipitates were taken.

Steel sheets in which the amount of Ti contained in precipitates having a size of less than 20 nm was 50% or more of the amount of Ti* expressed as formula (1) described below were selected from the hot-rolled steel sheets manufactured as described above. FIG. 1 shows the investigation results of the relationship between the bainitic ferrite fraction (%) and the tensile strength TS (MPa). As shown in FIG. 1, the tensile strength TS tends to increase as the bainitic ferrite fraction increases. At a bainitic ferrite fraction of 70% or more, the change in TS is small, and TS is stabilized.

For example, the bainitic ferrite fraction can be determined as follows. A portion of an L section (a section parallel to the rolling direction) of a steel sheet, the portion excluding surface layers each having a thickness equal to 10% of the thickness of the sheet, is etched with 5% nital. The microstructures of the etched portion are photographed with a scanning electron microscope (SEM) at a magnification of 1000×. Crystal grains having a feature in which grain boundaries have a step height in the vertical direction of 0.1 μm or more or in which corrosion marks (attributed to dislocation) are left in the grains are defined as bainitic ferrite. Bainitic ferrite is distinguished from other ferrite phases and different transformation phases such as pearlite and bainite. These are color-coded with image-analysis software. The area ratio is defined as the bainitic ferrite fraction.

Figure 2:
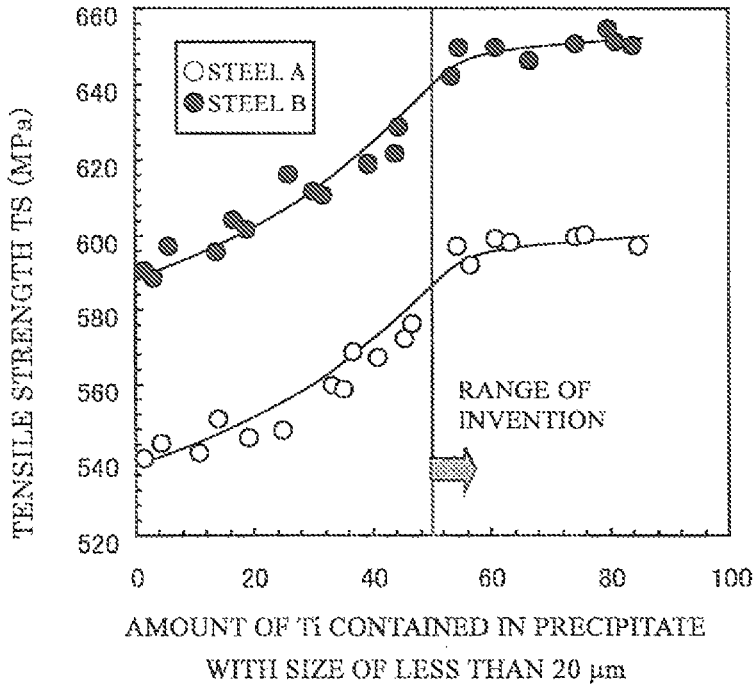
FIG. 2 shows the investigation results of the relationship between the proportion of the amount of Ti contained in a precipitate having a size of less than 20 nm with respect to Ti* and the tensile strength TS (MPa).

Similarly, steel sheets each having a bainitic ferrite fraction of 70% or more were selected from the hot-rolled steel sheets manufactured as described above. FIG. 2 shows the investigation results of the relationship between the proportion of the amount of Ti contained in a precipitate having a size of less than 20 nm with respect to Ti* expressed as formula (1) described below and the tensile strength TS (MPa). As described above, the precipitates each having a size of less than 20 nm and contributing to precipitation strengthening are composed of added Ti. Thus, whether Ti is efficiently precipitated as fine precipitates or not can be determined by the amount of Ti in the precipitate having a size of less than 20 nm. As shown in FIG. 2, TS tends to increase as the amount of Ti contained in the precipitate having a size of less than 20 nm increases. In the case where the amount of Ti contained in the precipitate is 50% or more of Ti*, the change in TS is small, and TS is stabilized.

From the above result, it is conceivable that in the case where the steel microstructures are controlled to have a bainitic ferrite fraction of 70% or more and where the amount of Ti contained in the precipitate having a size of less than 20 nm is controlled in the range of 50% or more of Ti* expressed as formula (1) described below, the resulting variations in strength are significantly small and practically satisfactory even if inevitable variations in strength occur because the cooling histories of the coil after winding are different for each position, $$Ti^*=[Ti]-48/14\times[N] \quad (1)$$

where [Ti] and [N] represent a Ti content (percent by mass) and a N content (percent by mass), respectively, of the steel sheet.

Thus, in the case where a steel sheet has microstructures whose bainitic ferrite fraction is 70% or more and that the amount of Ti contained in a precipitate having a size of less than 20 nm is 50% or more of Ti* expressed as formula (1) described above are met, at any position of a steel sheet, even if the cooling histories of a coil are different for each position, substantially the same amount of strengthening is obtained at any position of the steel sheet. Thus, the steel sheet has only small variation in strength and excellent uniformity in strength.

5) The amount of Ti contained in a precipitate having a size of less than 20 nm can be measured by a method described below.

After a sample is electrolyzed in an electrolytic solution by a predetermined amount, the test piece is taken out of the electrolytic solution and immersed in a solution having dispersibility. Then precipitates contained in this solution are filtered with a filter having the pore size of 20 nm. Precipitates passing through the filter having a pore size of 20 nm together with the filtrate each have a size of less than 20 nm. After filtration, the filtrate is appropriately analyzed by inductively-coupled-plasma (ICP) emission spectroscopy, ICP mass spectrometry, atomic absorption spectrometry or the like to determine the amount of Ti in the precipitates having a size of less than 20 nm.

6) An example of a preferred method for manufacturing a high-strength hot-rolled steel sheet will be described below.

The composition of a steel slab used in the manufacturing method is the same as the composition of the steel sheet described above. Further, the reason for the limitation of the composition is the same as above. The high-strength hot-rolled steel sheet is manufactured through a hot-rolling step of subjecting a raw material to rough hot rolling to form a hot-rolled steel sheet, the raw material being the steel slab having a composition within the range described above.

i) Heating Temperature: 1150° C. to 1300° C.

With respect to the heating temperature of a slab, the hot-rolled steel sheet is preferably heated to 1150° C. or higher so that undissolved Ti-containing carbide, such as TiC, may not be present in the heating stage. This is because the presence of the undissolved Ti-containing carbide adversely affects the tensile strength of a hot-rolled steel sheet. Hence, the absence of the undissolved Ti-containing carbide is preferred. However, heating at excessively high temperatures causes problems, for example, an increase in scale loss due to an increase in oxidation weight. Thus, the upper limit of the heating temperature of the slab is preferably set to 1300° C.

The steel slab heated under the foregoing conditions is subjected to hot rolling in which rough rolling and finish rolling are performed. The steel slab is formed into a sheet bar by the rough rolling. The conditions of the rough rolling need not be particularly specified. The rough rolling may be performed according to a common method. It is preferred to use what is called a "sheet-bar heater" from the viewpoint of reducing the heating temperature of the slab and preventing problems during hot rolling.

Then, the sheet bar is subjected to finish rolling to form a hot-rolled steel sheet.

ii) Finishing Temperature (FDT): 800° C. to 950° C.

A high finishing temperature results in coarse grains to reduce formability and is liable to cause scale defects. Hence, the finishing temperature is set to 950° C. or lower. A finishing temperature of less than 800° C. results in an increase in rolling force to increase the rolling load and an increase in rolling reduction to develop an abnormal texture in austenite non-recrystallization, which is not preferred from the viewpoint of achieving uniform strength. Accordingly, the finishing temperature is set in the range of 800° C. to 950° C. and preferably 840° C. to 920° C.

To reduce the rolling force during the hot rolling, some or all passes of the finish rolling may be replaced with lubrication rolling. Lubrication rolling is effective from the viewpoint of improving uniformity in the shape of a steel sheet and uniformity in strength. The coefficient of friction during lubrication rolling is preferably in the range of 0.10 to 0.25. Furthermore, a continuous rolling process is preferred in which a preceding sheet bar and a succeeding sheet bar are joined to each other and then the joined sheet bars are continuously finish-rolled. The use of the continuous rolling process is desirable from the viewpoint of achieving the stable operation of the hot rolling.

iii) Cooling at a Cooling Rate of 20° C./s to 80° C./s within 2 Seconds after Finish Hot Rolling When a time exceeding 2 seconds elapses between the start of cooling and completion of the finish rolling, coarse TiC and so forth tend to precipitate unevenly on a run-out table, which is apt to cause variations in strength. Furthermore, the same phenomenon is liable to occur when the cooling rate is less than 20° C./s. A cooling rate exceeding 80° C./s is liable to cause the formation of a hard low-temperature transformation phase, causing variations in strength. Thus, cooling is preferably performed at a cooling rate of 20° C./s to 80° C./s within 2 seconds after finish hot rolling.

iv) Cooling is Stopped at 620° C. or Lower, and then the Steel Sheet is Wound into a Coil at 550° C. or Higher.

A cooling stop temperature exceeding 620° C. is liable to cause uneven precipitation of coarsened carbide on the run-out table and results in increases in transformation and precipitation rates. This is liable to lead to nonuniform microstructures and nonuniform precipitates and larger variations in strength, strongly depending on a cooling rate after winding. A winding temperature of less than 550° C. results in an excessively small amount of carbide precipitates, thus causing difficulty in achieving desired strength. A further lower temperature results in the appearance of a low-temperature transformation phase, causing variations in strength and a reduction in ductility. Thus, the cooling is stopped at 620° C. or lower, and then the steel sheet is wound into a coil at 550° C. or higher.

In the case where variations in strength are taken into consideration in the coil, precipitation of the Ti-containing carbide such as TiC proceeds mainly in a cooling stage after completion of the winding. Hence, it is desirable to take the cooling histories of the steel sheet after the winding into consideration. In particular, the front and rear ends of the coil are rapidly cooled so that precipitation of the Ti-containing carbide does not sufficiently proceed, in some cases. Thus, the temperatures of the front and rear ends of the coil are increased with respect to the temperature of the inner portion of the coil other than the front and rear ends, thereby further improving variations in strength.

EXAMPLE 1

An example will be described below.

Molten steels having compositions shown in Table 1 were made with a converter and formed into slabs by a continuous casting process. These steel slabs were heated to 1250° C. and rough-rolled into sheet bars. Then, the resulting sheet bars were subjected to a hot-rolling step in which finish rolling was performed under conditions shown in Table 2, thereby forming hot-rolled steel sheets.

These hot-rolled steel sheets were subjected to pickling and temper rolling at an elongation of 0.5%. Regions extending from both sides to 10 mm from both sides in the width direction were removed by trimming. Various properties were evaluated. Steel sheets were taken at positions at which the innermost turn including the front end and the outermost turn including the rear end of the coil in the longitudinal direction were cut. Furthermore, steel sheets were taken at 20 equally divided points of the inner portion in the longitudinal direction. Test pieces for a tensile test and analytical samples of precipitates were taken from both sides of each of the steel sheets in the width direction and 8 equally divided points of each steel sheet in the width direction.

The test pieces for a tensile test were taken in a direction (L direction) parallel to a rolling direction and processed into JIS No. 5 test pieces. The tensile test was performed according to the regulation of JIS Z 2241 at a crosshead speed of 10 mm/min to determine tensile strength (TS). Table 2 shows the investigation results of tensile properties of the resulting hot-rolled steel sheets.

With respect to microstructures, a portion of an L section (a section parallel to a rolling direction) of each of the steel sheets, the portion excluding surface layers each having a thickness equal to 10% of the thickness of the sheet, was etched with nital. The microstructures of the etched portion were identified with a scanning electron microscope (SEM) at a magnification of 5000×. The bainitic ferrite fraction was measured by the method described above with image processing software.

The quantification of Ti in a precipitate having a size of less than 20 nm was performed by a quantitative procedure described below.

The resulting hot-rolled steel sheets described above were cut into test pieces each having an appropriate size. Each of the test pieces was subjected to constant-current electrolysis in a 10% AA-containing electrolytic solution (10 vol % acetylacetone-1 mass % tetramethylammonium chloride-methanol) at a current density of 20 mA/cm$^2$ to be reduced in weight by about 0.2 g.

After electrolysis, each of the test pieces having surfaces to which precipitates adhered was taken from the electrolytic solution and immersed in an aqueous solution of sodium hexametaphosphate (500 mg/l) (hereinafter, referred to as an "SHMP aqueous solution"). Ultrasonic vibration was applied thereto to separate the precipitates from the test piece. The separated precipitates were collected in the SHMP aqueous solution. The SHMP aqueous solution containing the precipitates was filtered with a filter having a pore size of 20 nm. After filtration, the resulting filtrate was analyzed with an ICP emission spectrometer to measure the absolute quantity of Ti in the filtrate. Then, the absolute quantity of Ti was divided by an electrolysis weight to obtain the amount of Ti (percent by mass) contained in the precipitates each having a size of less than 20 nm. The electrolysis weight was determined by measuring the weight of the test piece after the separation of the precipitates and subtracting the resulting weight from the weight of the test piece before electrolysis.

Next, the resulting amount of Ti (percent by mass) contained in the precipitates each having a size of less than 20 nm was divided by Ti* calculated by substituting the Ti content and the N content shown in Table 1 in formula (1), thereby determining the proportion (%) of the amount of Ti contained in the precipitates each having a size of less than 20 nm.

TABLE 1

| | Chemical component (% by mass) | | | | | | | | | |
|---|---|---|---|---|---|---|---|---|---|---|
| Symbol | C | Si | Mn | P | S | Al | N | Ti | Ti* | Remarks |
| A | 0.071 | 0.01 | 1.35 | 0.008 | 0.005 | 0.034 | 0.0035 | 0.035 | 0.023 | Adaptation example |
| B | 0.075 | 0.01 | 1.30 | 0.008 | 0.003 | 0.032 | 0.0032 | 0.045 | 0.034 | Adaptation example |
| C | 0.082 | 0.01 | 1.25 | 0.008 | 0.004 | 0.040 | 0.0030 | 0.058 | 0.048 | Adaptation example |
| D | 0.090 | 0.01 | 1.35 | 0.010 | 0.005 | 0.034 | 0.0015 | 0.05 | 0.045 | Adaptation example |
| E | 0.085 | 0.01 | 1.40 | 0.008 | 0.005 | 0.034 | 0.0020 | 0.032 | 0.025 | Adaptation example |
| F | 0.078 | 0.01 | 1.65 | 0.008 | 0.003 | 0.035 | 0.0015 | 0.042 | 0.037 | Adaptation example |
| G | 0.079 | 0.25 | 1.35 | 0.008 | 0.005 | 0.035 | 0.0030 | 0.034 | 0.024 | Adaptation example |
| H | 0.081 | 0.01 | 0.50 | 0.008 | 0.003 | 0.036 | 0.0032 | 0.042 | 0.031 | Comparative example |
| I | 0.040 | 0.01 | 1.35 | 0.009 | 0.002 | 0.034 | 0.0032 | 0.045 | 0.034 | Comparative example |
| J | 0.095 | 0.01 | 1.35 | 0.008 | 0.005 | 0.034 | 0.0032 | 0.025 | 0.014 | Comparative example |
| K | 0.082 | 0.01 | 1.35 | 0.008 | 0.005 | 0.036 | 0.0033 | 0.10 | 0.089 | Comparative example |

TABLE 2

| Steel sheet No. | Steel No. | Thickness mm | Heating temperature ° C. | Finishing temperature (FT) ° C. | Cooling start time s | Cooling rate ° C./s | Cooling stop temperature ° C. | Coiling temperature (CT) after finish hot rolling ° C. | Bainitic ferrite fraction % |
|---|---|---|---|---|---|---|---|---|---|
| 1 | A | 6.0 | 1220 | 880 | 1.7 | 25 | 600 | 580 | 89 |
| 2 | | 2.6 | 1220 | 880 | 0.8 | 55 | 600 | 580 | 85 |
| 3 | | 6.0 | 1100 | 880 | 1.7 | 25 | 600 | 580 | 87 |
| 4 | | 6.0 | 1220 | 1000 | 1.7 | 25 | 600 | 580 | 66 |
| 5 | | 6.0 | 1220 | 880 | 3.4 | 25 | 600 | 580 | 57 |
| 6 | | 6.0 | 1210 | 880 | 1.7 | 15 | 600 | 580 | 51 |
| 7 | | 6.0 | 1210 | 880 | 1.7 | 25 | 650 | 580 | 20 |
| 8 | | 6.0 | 1220 | 880 | 1.7 | 25 | 600 | 520 | 38 |
| 9 | B | 4.5 | 1220 | 880 | 1.4 | 35 | 600 | 580 | 76 |
| 10 | | 1.6 | 1220 | 880 | 0.6 | 60 | 600 | 580 | 75 |
| 11 | | 1.6 | 1220 | 880 | 0.6 | 120 | 600 | 580 | 27 |
| 12 | | 1.6 | 1220 | 880 | 0.6 | 60 | 650 | 580 | 26 |
| 13 | | 4.5 | 1220 | 880 | 1.4 | 35 | 600 | 520 | 29 |

TABLE 2-continued

| | | | | | | | | | |
|---|---|---|---|---|---|---|---|---|---|
| 14 | C | 3.2 | 1230 | 880 | 0.9 | 40 | 600 | 580 | 89 |
| 15 | D | 6.0 | 1220 | 880 | 1.7 | 25 | 600 | 580 | 77 |
| 16 | E | 6.0 | 1210 | 880 | 1.7 | 25 | 600 | 580 | 86 |
| 17 | F | 6.0 | 1230 | 870 | 1.7 | 25 | 600 | 580 | 79 |
| 18 | G | 4.5 | 1230 | 880 | 1.4 | 35 | 600 | 580 | 76 |
| 19 | H | 6.0 | 1230 | 890 | 1.7 | 25 | 600 | 580 | 30 |
| 20 | I | 6.0 | 1230 | 890 | 1.7 | 25 | 600 | 580 | 46 |
| 21 | J | 6.0 | 1230 | 870 | 1.7 | 25 | 600 | 580 | 36 |
| 22 | K | 6.0 | 1220 | 870 | 1.7 | 25 | 600 | 580 | 26 |

| Steel sheet No. | Amount of Ti present in precipitate with size of less than 20 nm % by mass | Proportion of amount of Ti contained in precipitate with size of less than 20 nm % | Tensile strength TS MPa | Proportion of compliant steel micro-structure % | Proportion of compliant TS % | ΔTS MPa | Remarks |
|---|---|---|---|---|---|---|---|
| 1 | 0.016 | 70 | 619 | 100 | 100 | 46 | Inventive example |
| 2 | 0.015 | 66 | 601 | 100 | 100 | 34 | Inventive example |
| 3 | 0.010 | 44 | 580 | 4 | 100 | 68 | Comparative example |
| 4 | 0.016 | 69 | 613 | 5 | 100 | 65 | Comparative example |
| 5 | 0.010 | 42 | 600 | 3 | 82 | 53 | Comparative example |
| 6 | 0.009 | 38 | 603 | 0 | 88 | 62 | Comparative example |
| 7 | 0.009 | 39 | 548 | 0 | 59 | 69 | Comparative example |
| 8 | 0.007 | 29 | 583 | 0 | 64 | 54 | Comparative example |
| 9 | 0.018 | 53 | 635 | 100 | 100 | 41 | Inventive example |
| 10 | 0.026 | 75 | 623 | 100 | 100 | 43 | Inventive example |
| 11 | 0.021 | 61 | 678 | 5 | 100 | 62 | Comparative example |
| 12 | 0.013 | 39 | 532 | 0 | 64 | 84 | Comparative example |
| 13 | 0.010 | 28 | 586 | 0 | 73 | 69 | Comparative example |
| 14 | 0.037 | 77 | 662 | 100 | 100 | 30 | Inventive example |
| 15 | 0.031 | 69 | 659 | 100 | 100 | 49 | Inventive example |
| 16 | 0.016 | 62 | 596 | 100 | 100 | 36 | Inventive example |
| 17 | 0.025 | 67 | 620 | 100 | 100 | 42 | Inventive example |
| 18 | 0.018 | 78 | 643 | 100 | 100 | 41 | Inventive example |
| 19 | 0.015 | 48 | 525 | 4 | 0 | 41 | Comparative example |
| 20 | 0.015 | 43 | 502 | 6 | 0 | 57 | Comparative example |
| 21 | 0.005 | 34 | 532 | 5 | 0 | 31 | Comparative example |
| 22 | 0.061 | 69 | 791 | 6 | 100 | 64 | Comparative example |

In the results shown in Table 2, values of the proportion of the bainitic ferrite fraction, the amount of Ti contained in precipitates each having a size of less than 20 nm with respect to Ti* expressed as formula (1), and the tensile strength TS are defined as representative values at a middle portion in the longitudinal and transverse directions. The proportion of compliant steel microstructures is defined as the proportion of points where both requirements of the bainitic ferrite fraction and the proportion of the amount of Ti in the Ti-containing precipitates each having a size of less than 20 nm are satisfied to 189 measurement points. The proportion of compliant TS is defined as the proportion of points where TS is 540 MPa or more to 189 measurement points. ΔTS is a value obtained by determining the standard deviation σ of TS values at 189 measurement points and multiplying the standard deviation σ by 4.

As is clear from the investigation results shown in Table 2, in any inventive example, the steel sheet having satisfactory uniformity in strength is manufactured, in which the steel sheet has a TS of 540 MPa or more, which is high strength, and the variations in strength (ΔTS) in the coil in the in-plane direction are 50 MPa or less.

INDUSTRIAL APPLICABILITY

It is possible to stably manufacture a hot-rolled steel sheet having a tensile strength (TS) of 540 MPa or more and only small variations in strength at low cost, which provides a marked, industrially beneficial effect. For example, the use of a high-strength hot-rolled steel sheet for automotive parts reduces variations in the amount of springback after formation using the high-tensile steel sheet and variations in collision characteristics, thus making it possible to design automobile bodies with higher accuracy and to contribute sufficiently to the collision safety and weight reduction of automobile bodies.

The invention claimed is:

1. A high-strength hot-rolled steel sheet comprising on a mass percent basis, 0.05%-0.095% C, 0.5% or less Si, 0.8%-1.8% Mn, 0.030% or less P, 0.01% or less S, 0.005%-0.1% Al, 0.01% or less N, 0.030%-0.080% Ti, the balance being Fe and incidental impurities, and metal microstructures whose bainitic ferrite fraction is 70% or more and contain precipitates containing Ti and C having a size less than 20 nm, wherein the amount of Ti present in the precipitates having a size of less than 20 nm is 50% or more of the value of Ti* calculated using formula (1):

$$Ti^*=[Ti]-48/14\times[N] \quad (1)$$

where [Ti] and [N] represent a Ti content (percent by mass) and a N content (percent by mass), respectively, and the steel sheet has a tensile strength TS of 540 to 780 MPa and variations in strength ΔTS in a coil in an in-plane direction are 50 MPa or less.

2. A method for manufacturing a high-strength hot-rolled steel sheet comprising:

heating a steel slab to 1150° C. to 1300° C., the steel slab containing on a mass percent basis, 0.05%-0.095% C; 0.5% or less Si, 0.8%-1.8% Mn, 0.030% or less P, 0.01% or less S, 0.005%-0.1% Al, 0.01% or less N, 0.030%-0.080% Ti, and the balance being Fe and incidental impurities;

subjecting the slab to finish hot rolling at a finishing temperature of 800° C. to 950° C.;

starting cooling at a cooling rate of 20° C./s to 80° C./s within 2 seconds after completion of the finish hot rolling;

stopping cooling at 620° C. or lower; and subsequently performing coiling at 550° C. or higher such that the steel sheet contains precipitates containing Ti and C having a size less than 20 nm, respectively, has a tensile strength TS of 540 to 780 MPa and variations in strength ΔTS in a coil in an in-plane direction are 50 MPa or less.

3. A method for manufacturing a high-strength hot-rolled steel sheet comprising:

heating a steel slab to 1150° C. to 1300° C., the steel slab containing on a mass percent basis, 0.05%-0.095% C; 0.5% or less Si, 0.8%-1.8% Mn, 0.030% or less P, 0.01% or less S, 0.005%-0.1% Al, 0.01% or less N, 0.030%-0.080% Ti, and the balance being Fe and incidental impurities;

subjecting the slab to finish hot rolling at a finishing temperature of 800° C. to 950° C.;

starting cooling at a cooling rate of 20° C./s to 80° C./s within 2 seconds after completion of the finish hot rolling;

stopping cooling at 620° C. or lower; and subsequently performing coiling at 550° C. or higher such that the steel sheet contains precipitates containing Ti and C having a size less than 20 nm, respectively, wherein the amount of Ti present in the precipitates having a size of less than 20 nm is 50% or more of the value of Ti* calculated using formula (1):

$$Ti^*=[Ti]-48/14\times[N] \quad (1)$$

where [Ti] and [N] represent a Ti content (percent by mass) and a N content (percent by mass), respectively, and the steel sheet has a tensile strength TS of 540 to 780 MPa and variations in strength ΔTS in a coil in an in-plane direction are 50 MPa or less.

* * * * *